US007686646B2

(12) United States Patent
Lee et al.

(10) Patent No.: US 7,686,646 B2
(45) Date of Patent: Mar. 30, 2010

(54) ELECTRICAL CONNECTOR

(75) Inventors: Kuo-Chi Lee, Taipei County (TW); Chin-Huang Lin, Taipei County (TW)

(73) Assignee: Dragonstate Technology Co., Ltd., Taipei (TW)

( * ) Notice: Subject to any disclaimer, the term of this patent is extended or adjusted under 35 U.S.C. 154(b) by 0 days.

(21) Appl. No.: 12/128,962

(22) Filed: May 29, 2008

(65) Prior Publication Data

US 2009/0258536 A1 Oct. 15, 2009

(30) Foreign Application Priority Data

Apr. 14, 2008 (TW) ..... 97206332 U

(51) Int. Cl.
*H01R 13/60* (2006.01)

(52) U.S. Cl. ..... 439/567; 439/939

(58) Field of Classification Search ..... 439/567, 439/597, 563, 564, 607, 939, 95, 573
See application file for complete search history.

(56) References Cited

U.S. PATENT DOCUMENTS 6,039,611 A * 3/2000 Yang ..... 439/701
6,132,253 A * 10/2000 Wu ..... 439/607
6,533,612 B1 * 3/2003 Lee et al. ..... 439/564
6,986,681 B2 * 1/2006 Tsai ..... 439/607
7,018,237 B2 * 3/2006 Zhan et al. ..... 439/607
7,217,146 B2 * 5/2007 Meister et al. ..... 439/148
7,270,570 B1 * 9/2007 Hamner et al. ..... 439/607
D559,190 S * 1/2008 Arai et al. ..... D13/147
7,445,498 B2 * 11/2008 Tsuo ..... 439/562
2006/0234554 A1 * 10/2006 Tsai ..... 439/607

* cited by examiner

*Primary Examiner*—Tho D Ta
*Assistant Examiner*—Travis Chambers
(74) *Attorney, Agent, or Firm*—Rosenberg, Klein & Lee

(57) ABSTRACT

An electrical connector includes a mount plate and a metallic housing. The metallic housing includes a metallic frame and at least one hook-shaped rib which extend from the metallic frame and are used to hold the mount plate. The mount plate is made of low-cost material to replace expensive side tab extending from the metallic housing. Thus, size of mould for the metallic housing is decreased, scraps is fewer and cost is lowered.

11 Claims, 14 Drawing Sheets

ELECTRICAL CONNECTOR

BACKGROUND OF THE INVENTION

1. Field of the Invention

The present invention relates to an electrical connector, and in particular to an electrical connector using a low-cost mount plate to hold metallic housing so that the electrical connector is held at a computer case.

2. Description of Related Art

Electrical connectors are implemented within cases of most electronic appliances such as personal computers and are used to transmit signals to outer appliances. In prior art, the electrical connectors are mostly covered by metallic housings so as to shield electromagnetic interferences, and the electrical connectors are fixed to printed circuit boards by soldering the metallic housings to the printed circuit boards.

However, when a plug is unplugged from the electrical connector, an external force is applied to the electrical connector so that the electrical connector may be got loose. Thus, a side tab extends from the metallic housing so that the electrical connector is fixed to the case by fixing the side tab and the case together.

Furthermore, most metallic housings are made of stainless steel and very expensive. The metallic housings have a lion's share in production cost when we are in low-profit market. The metallic housing with the side tabs results in bigger moulds, and cost of moulds will depend on size of the moulds and increase significantly. Even worse, it leads to much more scraps, higher cost and waste of resource.

Thus, there is a need for an electrical connector which is made of low-cost metallic housing.

SUMMARY OF THE INVENTION

It is an object of the present invention to provide an electrical connector with low-cost mount plate. The mount plate is provided at a metallic housing of the electrical connector so as to replace the side tab extending from the metallic housing and save cost.

To achieve the above object, the present invention provides an electrical connector including a mount plate and a metallic housing. The metallic housing includes a metallic frame and at least one hook-shaped rib which extend from the metallic frame and are used to hold the mount plate. The mount plate is made of low-cost material and chosen from a group including iron and plastic. The metallic housing is made of stainless steels.

Advantages of the present invention is to use low-cost mount plate to replace the side tab extending from the metallic housing so that size of mould for the metallic housing is decreased, scraps is fewer and cost is lowered.

BRIEF DESCRIPTION OF THE DRAWINGS

The present invention can be fully understood from the following detailed description and preferred embodiment with reference to the accompanying drawings, in which.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
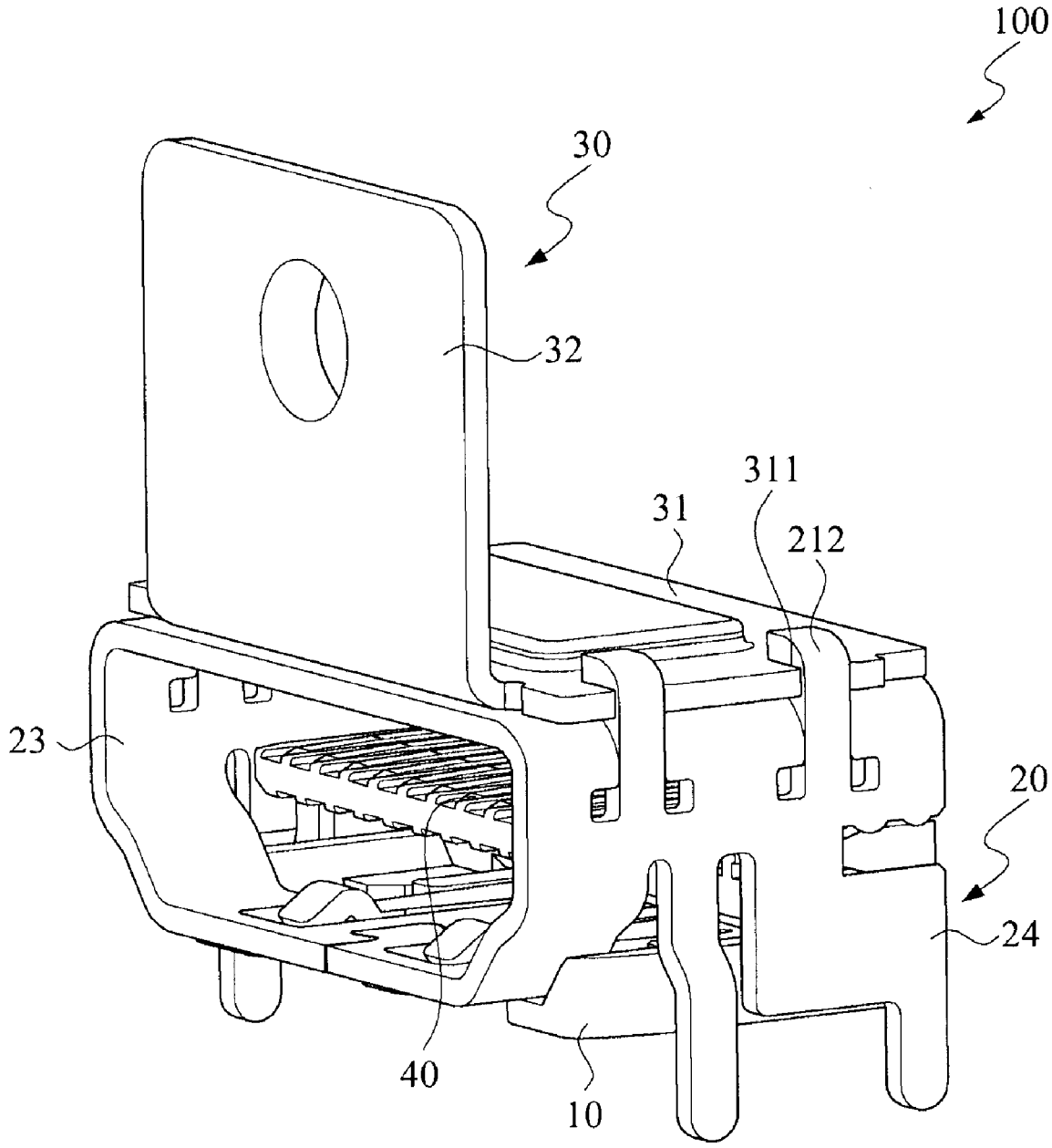
FIG. 1 is a perspective view of an electrical connector according to the first embodiment of the present invention.

Referring to FIG. 1, it illustrates a perspective view of an electrical connector 100 according to the first embodiment of the present invention. The electrical connector 100 can be a receptacle, and includes an insulation frame 10, a metallic housing 20 and a mount plate 30. A plurality of terminals 40 are implemented within the insulation frame 10 and are used to transmit signals or supply power. The metallic housing 20 is used to cover the insulation frame 10 and a receptacle hole 23 for receiving a plug (not shown), and includes a metallic frame 24 and at least one hook-shaped rib 212 extending from the metallic frame 24 and are used to hold the mount plate 30. The mount plate 30 is fixed at the metallic frame 24 of the metallic housing 20, and has a plurality of retaining part 311. The retaining part 311 respectively correspond to and hooked by the hook-shaped ribs 212.

Figure 2:
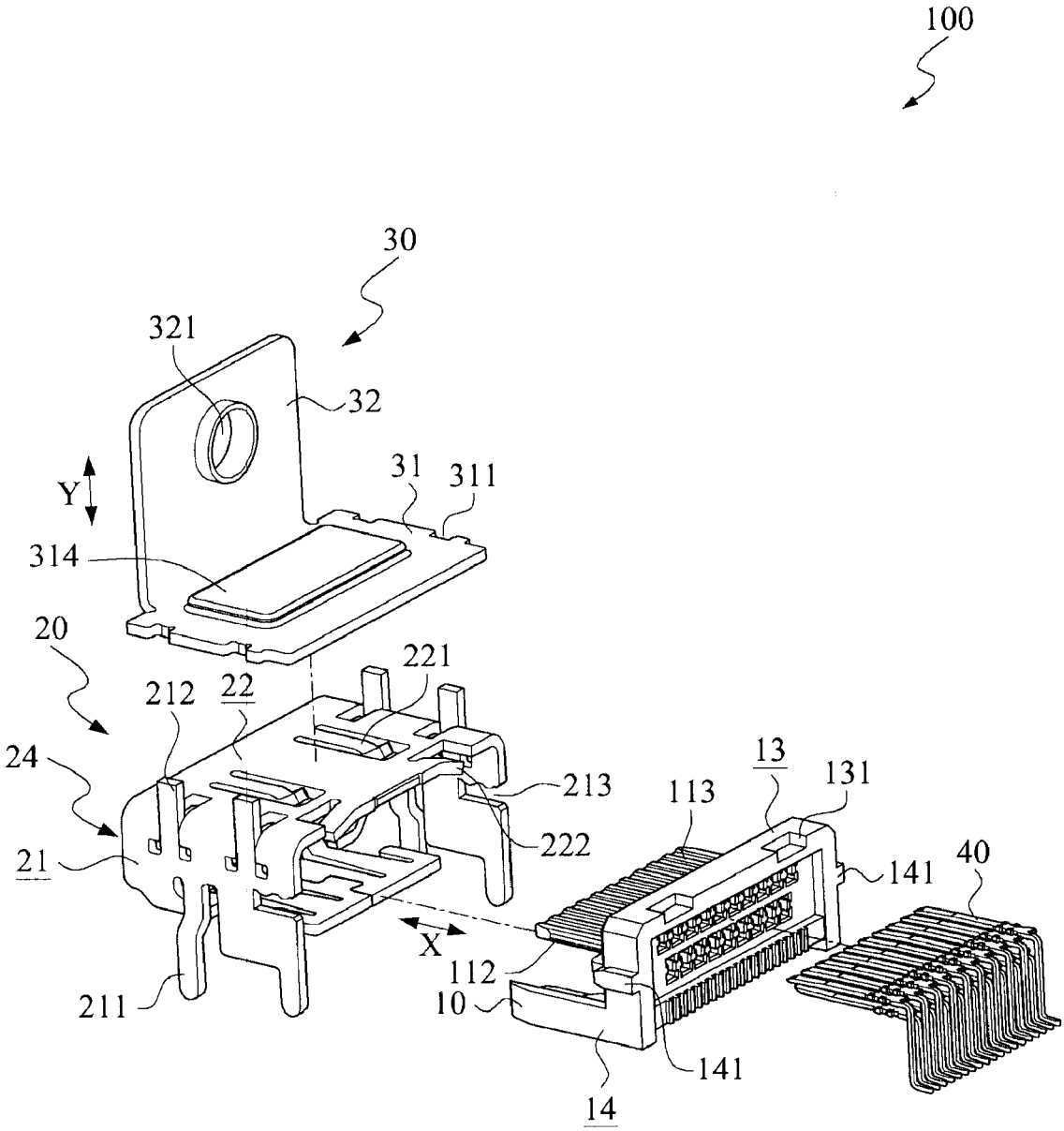
FIG. 2 is an exploded view of an electrical connector according to the first embodiment of the present invention.
Figure 3:
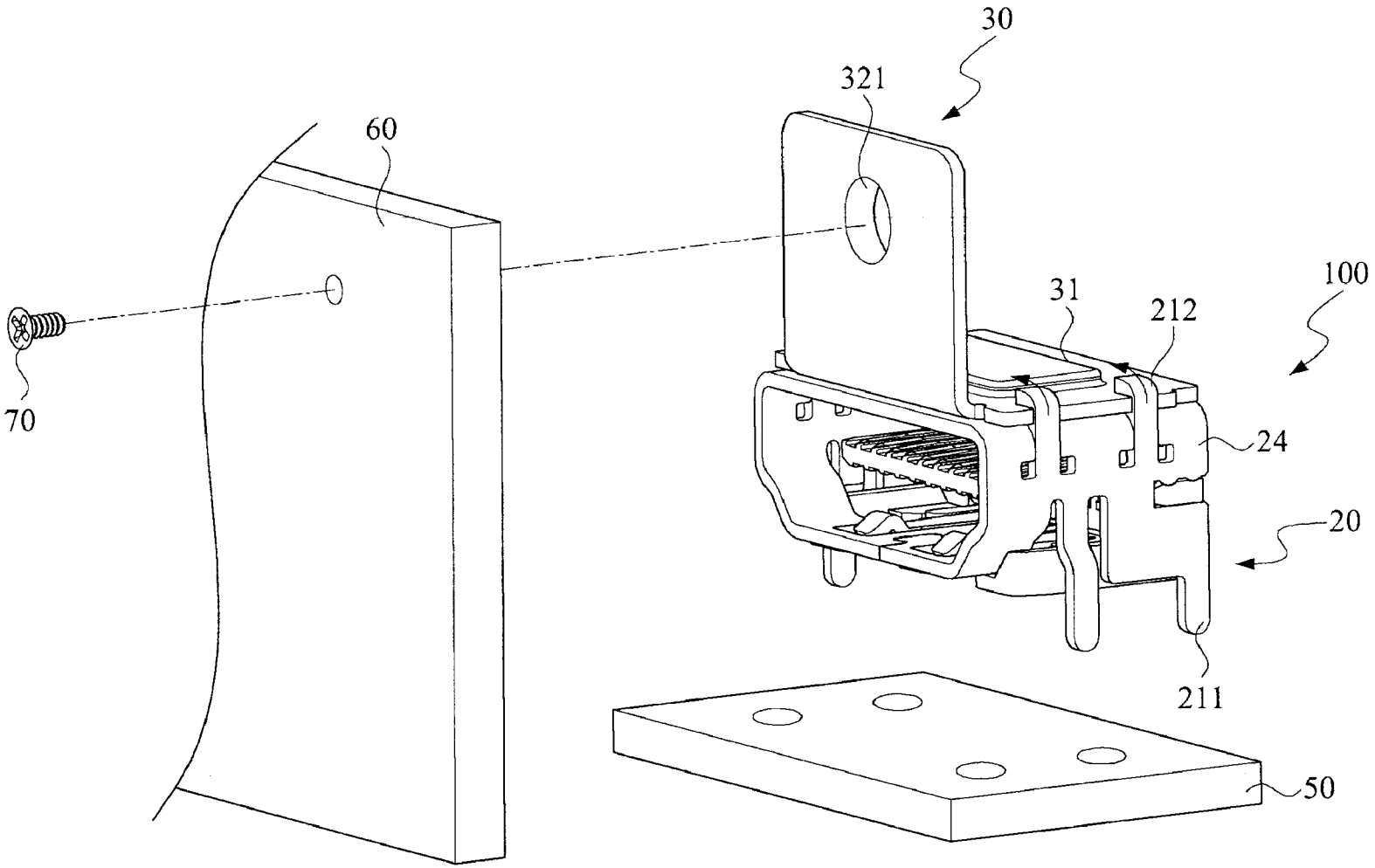
FIG. 3 is another perspective view of an electrical connector according to the first embodiment of the present invention.
Figure 4:
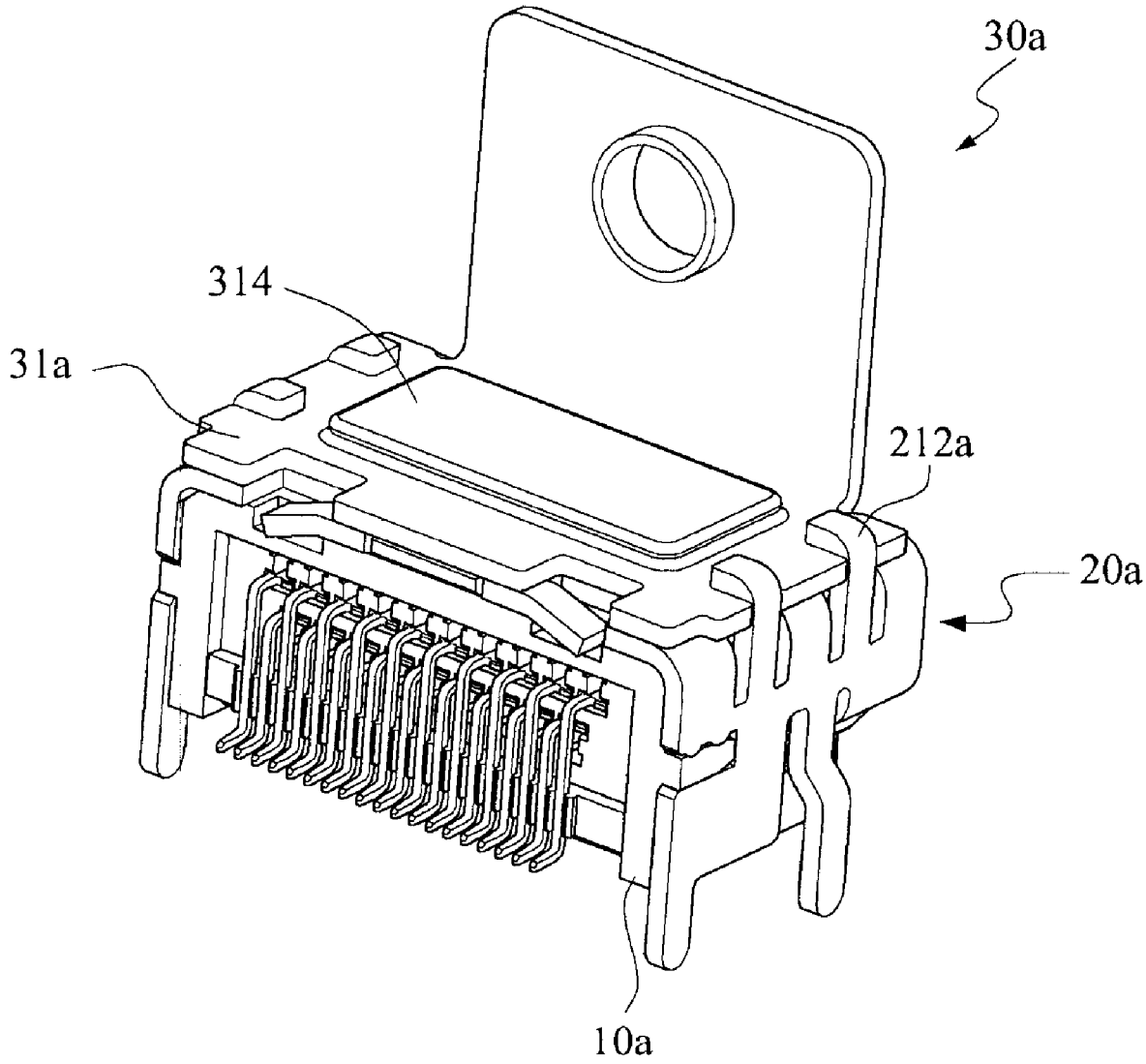
FIGS. 4 and 4A-4D are perspective views of an electrical connector according to the second embodiment of the present invention.
Figure 4A:
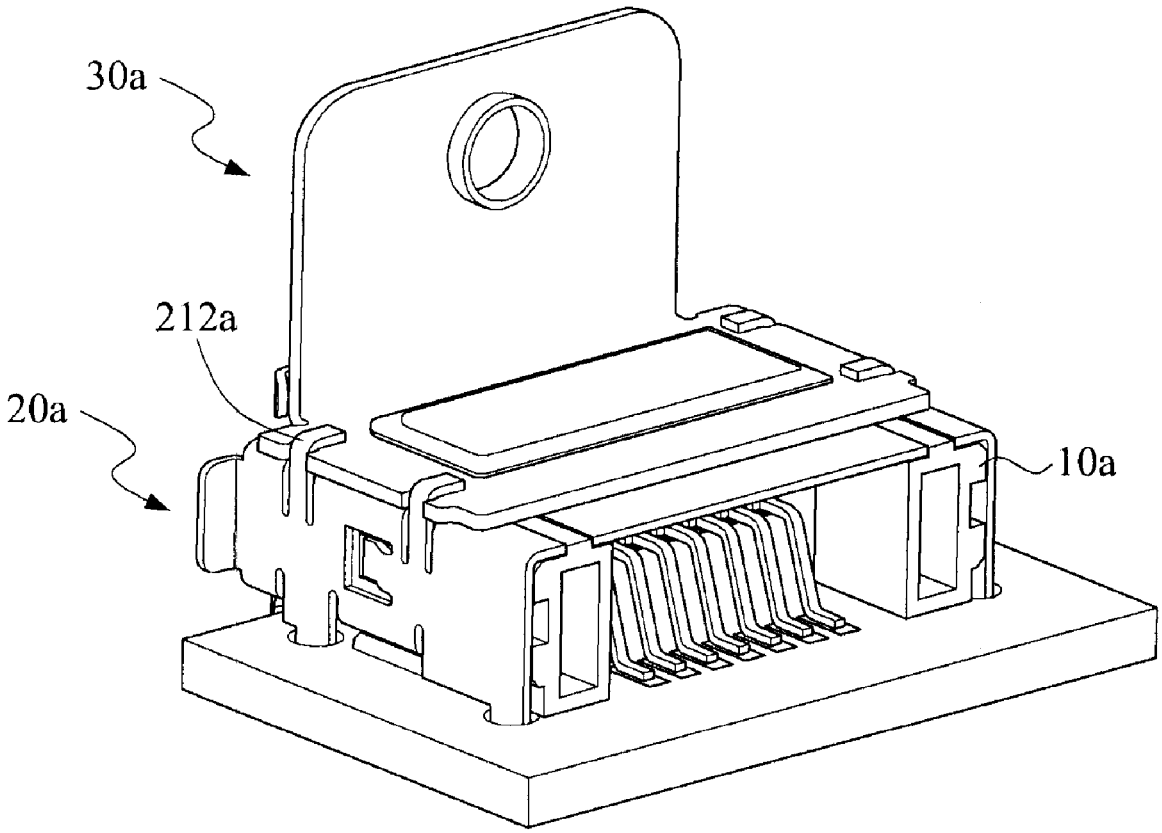
Figure 4B:
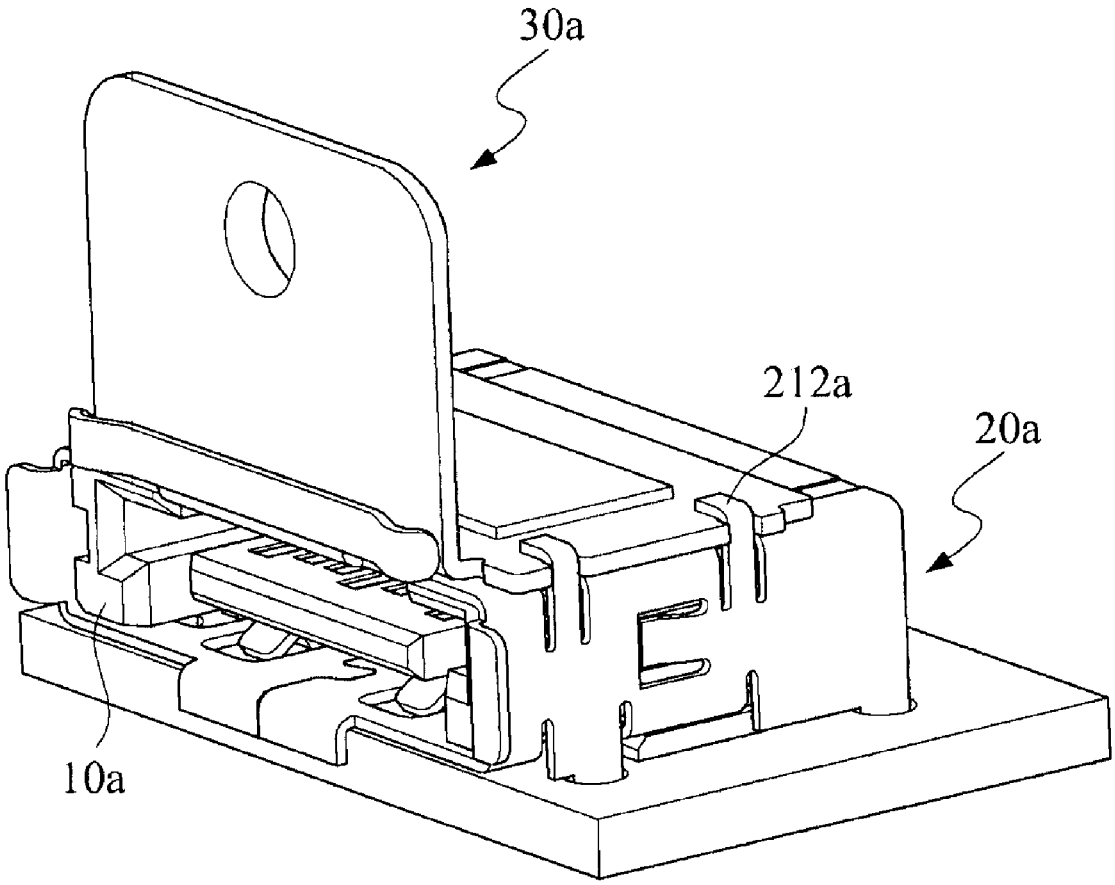
Figure 4C:
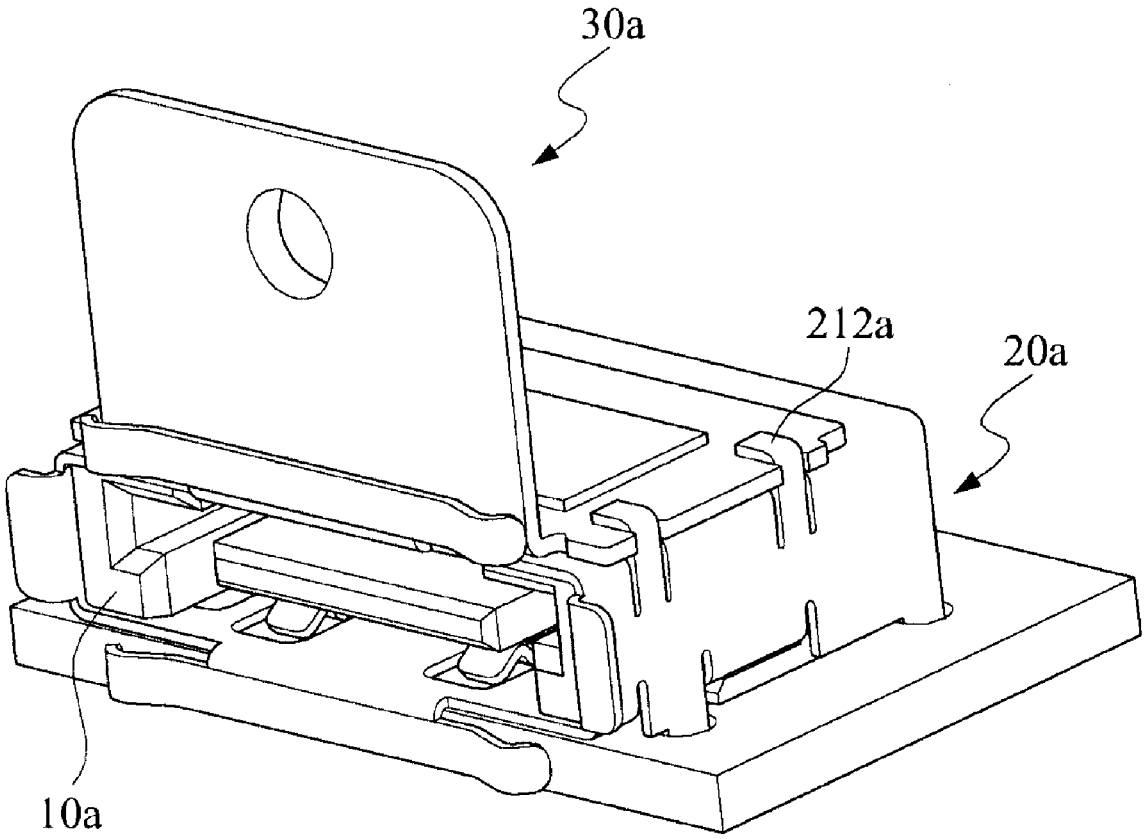
Figure 4D:
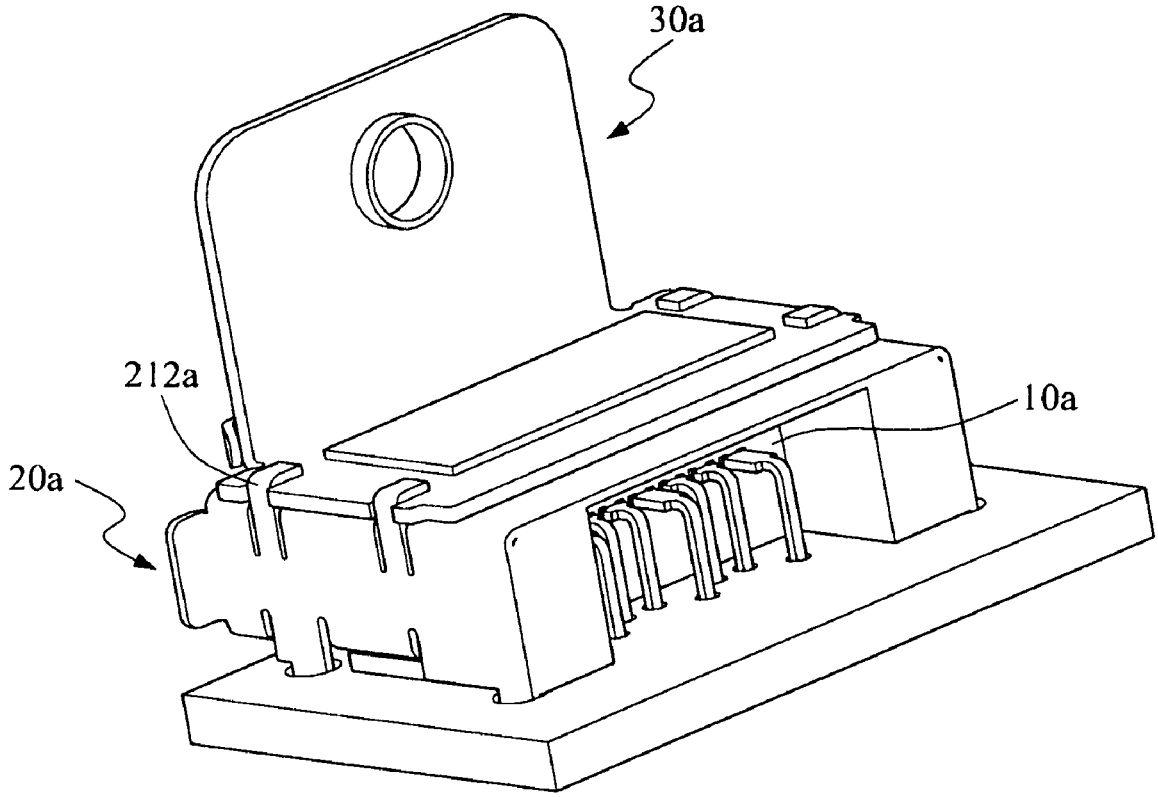

Referring FIGS. 2 and 3, FIG. 2 illustrates an exploded view of an electrical connector 100 according to the first embodiment of the present invention. FIG. 3 illustrates another perspective view of an electrical connector 100 according to the first embodiment of the present invention. A tongue 112 extends outwardly and along in an assembling direction X and have a plurality of terminal grooves 113 which are respectively positioned within the terminals 40. The insulation frame 10 has a top surface 13 and a side surface 14, and a retention groove 131 is positioned at the edge of the top surface 13. A stop block 141 is positioned on the side surface 14 of the insulation frame 10.

The metallic housing 20 is made of metal by punching process, and includes a metallic frame 24, a plurality of solder areas 211 and a plurality of hook-shaped ribs 212. The metallic frame 24 includes two side surfaces 21 and an attached plate 22, and is a cylindrical structure extending along the assembling direction X. The metallic frame 24 extends along the assembling direction X and is used to cover the insulation frame 10. The solder areas 211 extend from the side surfaces 21 of the metallic frame 24 and along the extension direction Y, and are fixed or welded at a substrate 50 (refer to FIG. 3) which may be a printed circuit board.

The hook-shaped ribs 212 extend from the side surfaces 21 or the attached plate 22 of the metallic frame 24 along the extension direction Y, and is integrally formed with the metallic frame 24. The hook-shaped ribs 212 have L-shaped structure and higher than the attached plate 22. As shown in FIG. 2 the hook-shaped ribs 212 have not been bent, and referring to FIG. 3, the hook-shaped ribs 212 are bend after the mount plate 30 is positioned at the metallic frame 24 so as to hold the mount plate 30. A guiding groove 213 is positioned at each of the side surfaces 21, and when the metallic frame 24 is assembled with the insulation frame 10 along the assembling direction X, the guiding grooves 213 correspond to the stop blocks 141 of the metallic frame 24 so that the stop blocks 141 are respectively guided by the guiding grooves 213 to have the metallic housing 20 positioned at the insulation frame 10.

A ground terminal 221 and a snap extension 222 are positioned at the attached plate 22 of the metallic frame 24, and when a plug (not shown) is plugged into the electrical connector 100 of the present invention, the ground terminal 221 provides functionality of grounding and is integrally formed with the metallic frame 24. Edge of the attached plate 22 corresponds to the snap extension 222 of the retention groove 131 of the insulation frame 10. When the metallic frame 24 is assembled with the insulation frame 10 along the assembling direction X, the snap extension 222 is restrained by the retention groove 131 so that the metallic housing 20 is attached at the insulation frame 10.

The mount plate 30 is made from a metallic plate by punching process, and has a mount frame 31, a mount portion 32 and a cover plate 314. The mount frame 31 is positioned at the attached plate 22 of the metallic frame 24, and the retaining part 311 are positioned at the edge of the mount frame 31 and can be a through hole or a groove. The hook-shaped ribs 212 of the metallic housing 20 are respectively hooked by the retaining part 311 so that the mount frame 31 is held between the hook-shaped ribs 212 and the attached plate 22. Then, the mount plate 30 is assembled with the metallic housing 20 by the hook-shaped ribs 212. At least one through hole (not shown) are positioned at the mount frame 31 and correspond with the ground terminal 221 so that the ground terminal 221 respectively expose out of the through hole. The cover plate 314 is positioned at the surface of the mount frame 31 so as to cover the through hole and enhance to prevent electromagnetic interferences.

The mount portion 32 extends from the mount frame 31 along the extension direction Y, and has a screw hole 321. The mount portion 32 is fixed at a object 60 (refer to FIG. 3) by threading a fixing element 70 through the screw hole 321 so that the electrical connector 100 is assembled with the object 60. The fixing element 70 may be a screw, and the object 60 may be a computer case.

According the present invention, the hook-shaped ribs 212 and the retaining part 311 have many alternatives and variances. Many structures where the metallic housing 20 and the mount plate 30 are assembled are within scope and spirits of claims described in the present invention.

According the present invention, the metallic housing 20 and the mount plate 30 may be made of different materials. The mount plate 30 is made of low-cost material and chosen from a group including iron and plastic. The metallic housing 20 is made of stainless steels which is much more expensive so cost is higher. If the mount plate 30 is made of low-cost material so cost will be lowered.

Referring to FIGS. 4 and 4A-4D, they illustrate the perspective views of an electrical connector 100 according to the second embodiment of the present invention. Like the first embodiment, the mount plate 30*a* is restrained by the hook-shaped ribs 212*a* of the metallic housing 20*a*. Designs of the insulation frame 10*a*, the metallic housing 20*a* and the mount plate 30*a* have alternatives and depend on different products, but these designs will be assembled by the method described in the present invention.

Figure 5:
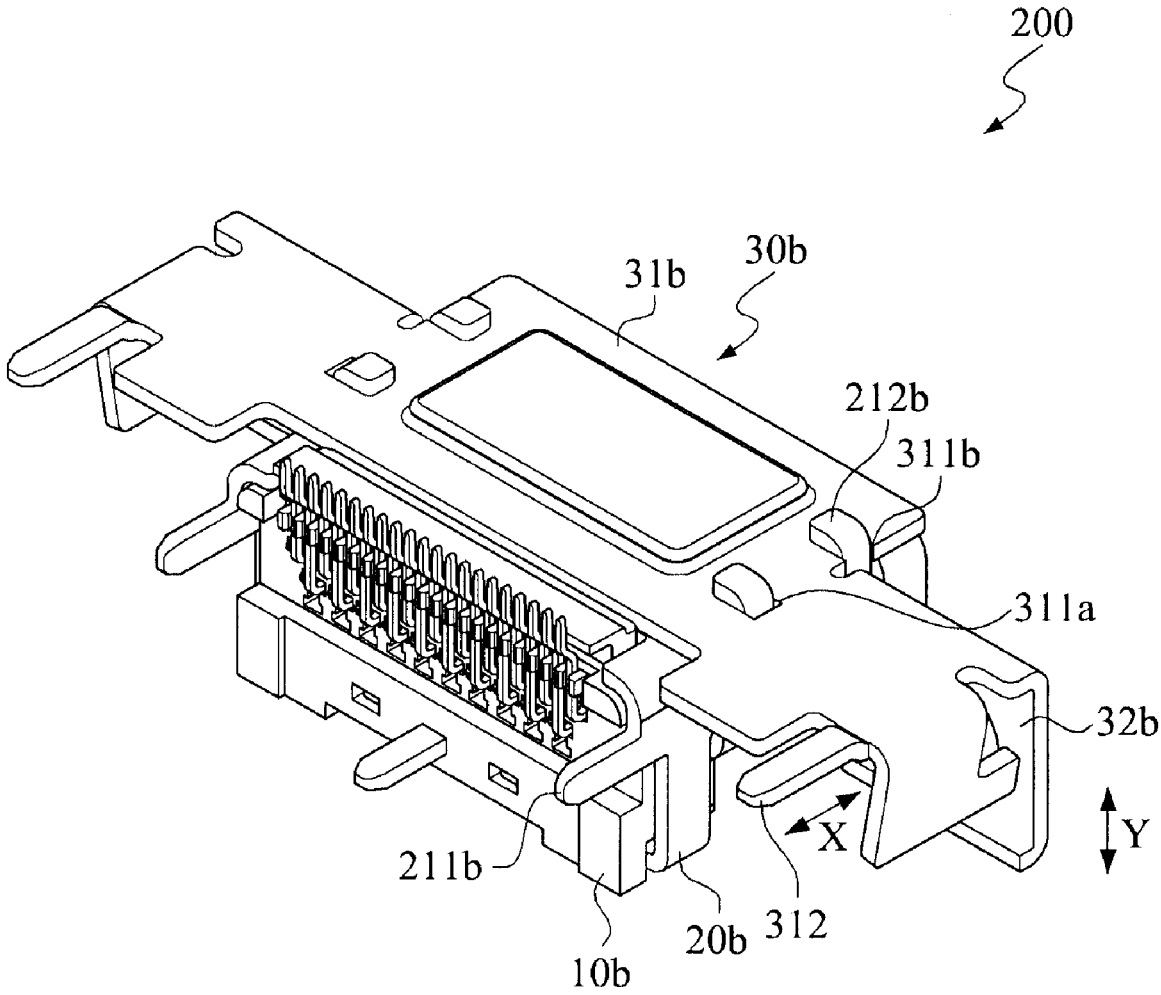
FIG. 5 is a perspective view of an electrical connector according to the third embodiment of the present invention.
Figure 6:
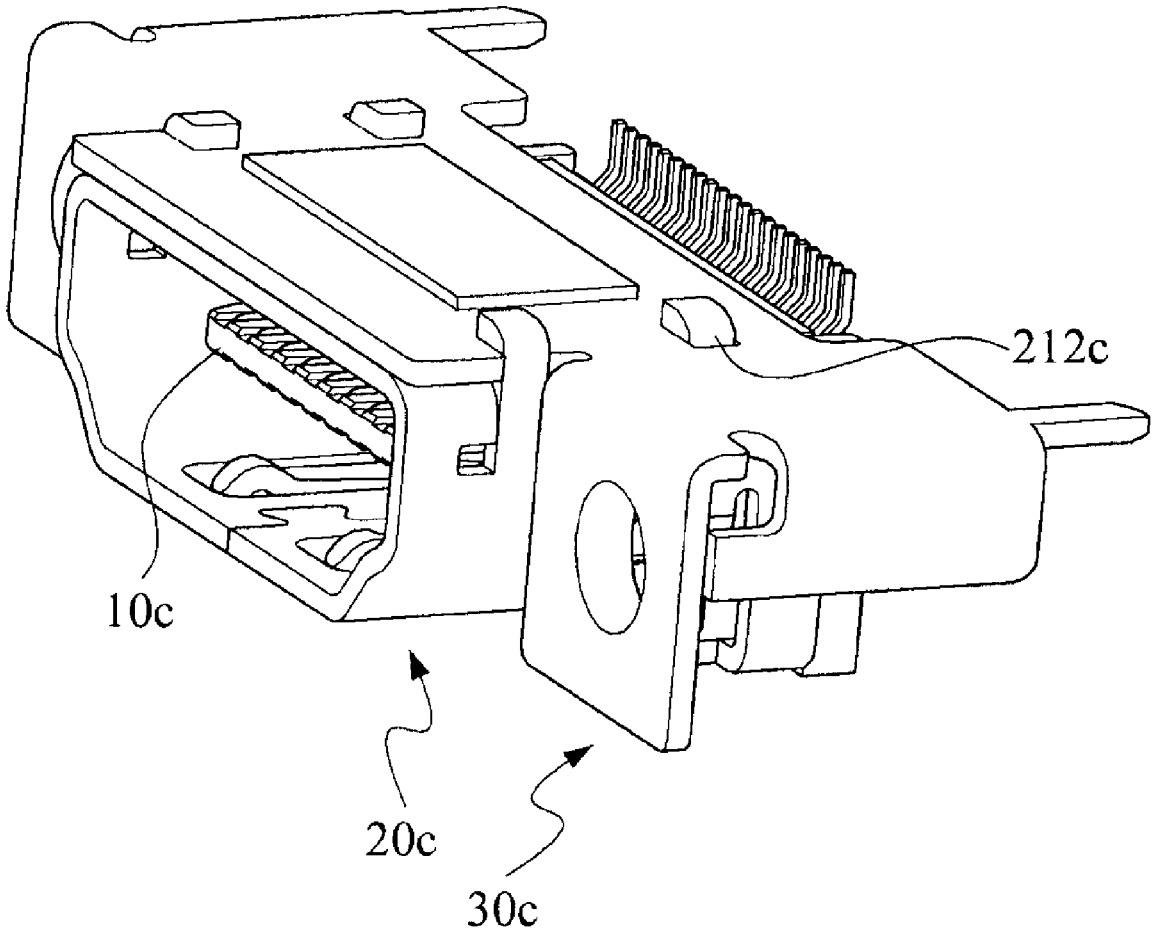
FIGS. 6 and 6A-6D are perspective views of an electrical connector according to the fourth embodiment of the present invention.
Figure 6A:
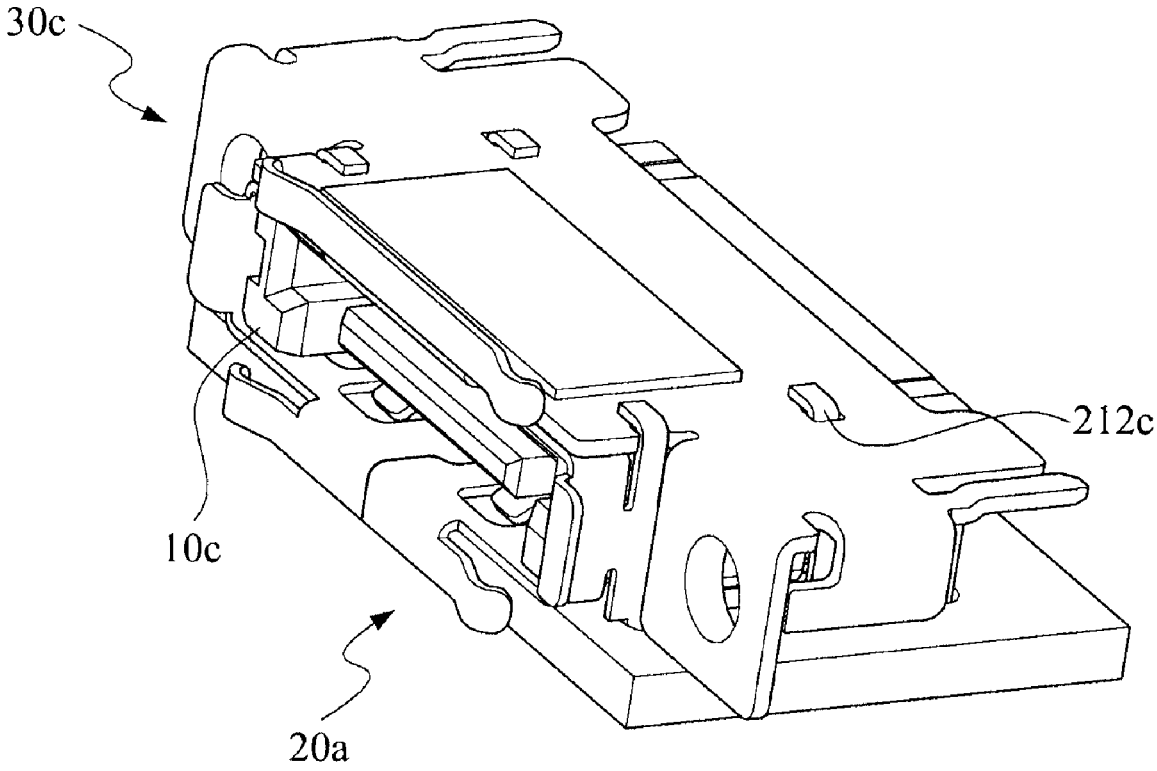
Figure 6B:
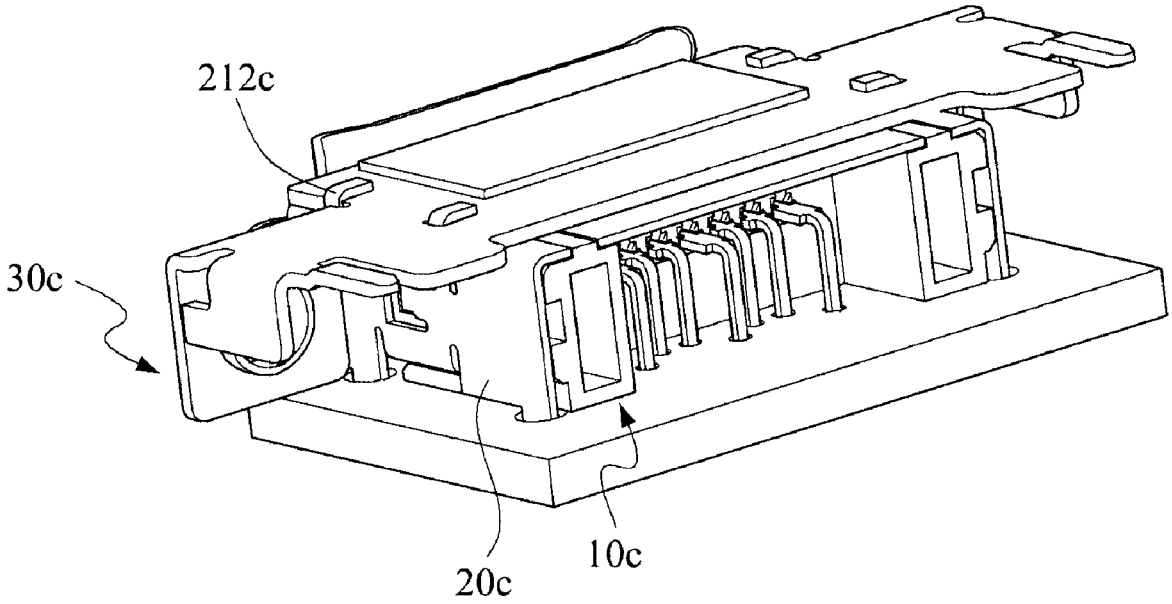
Figure 6C:
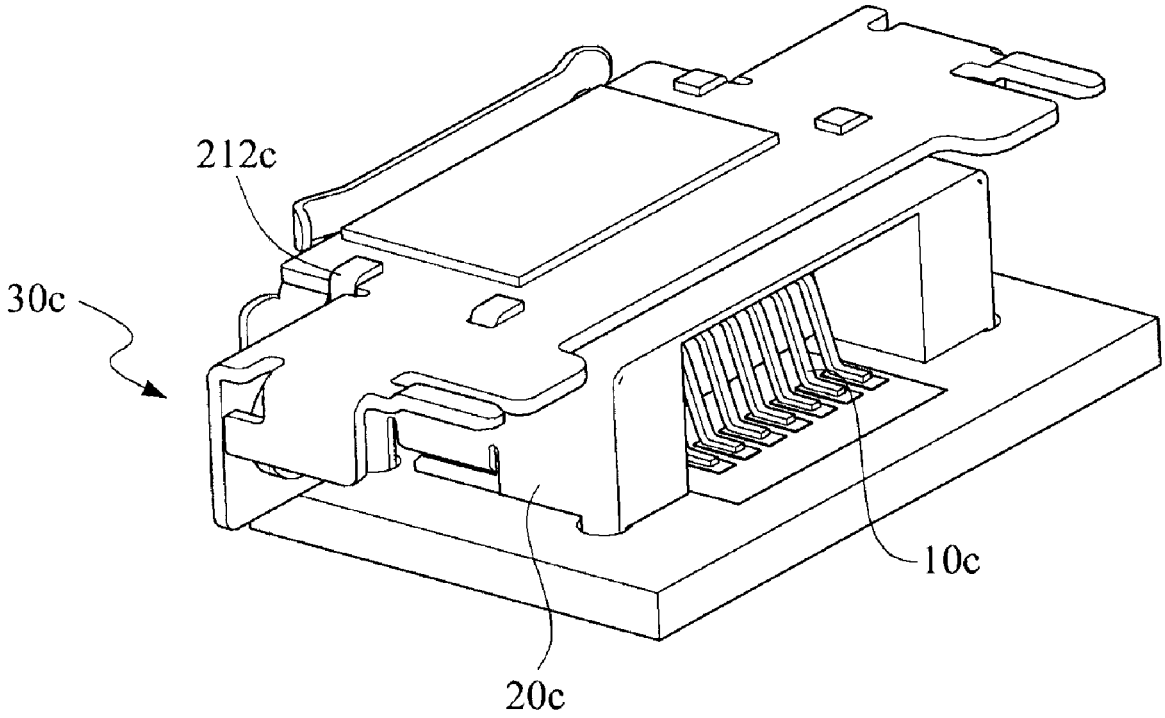
Figure 6D:
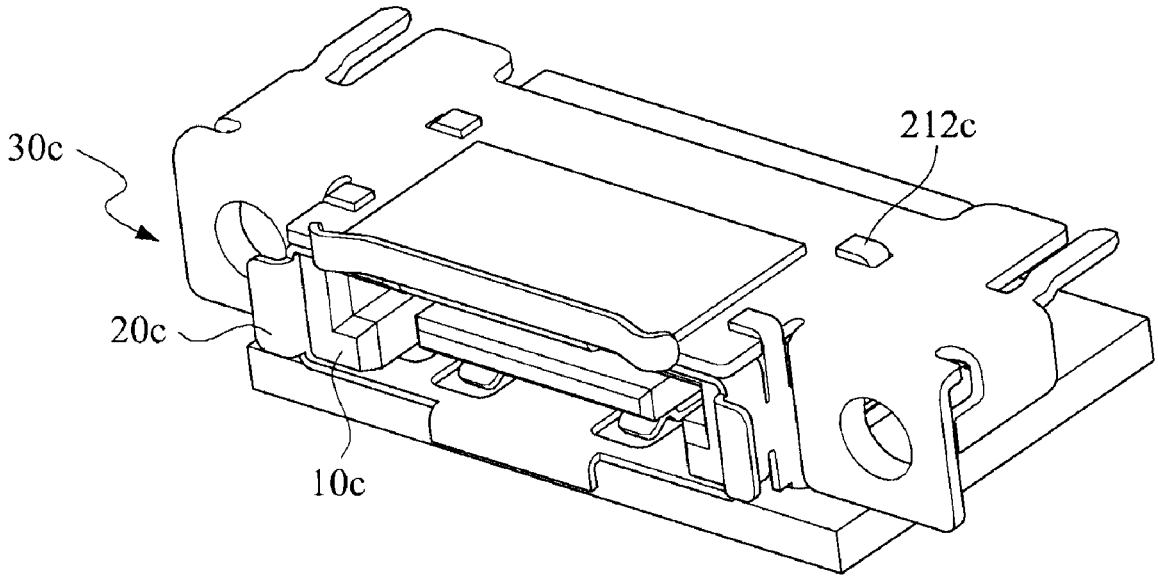

Referring to FIG. 5, it illustrates a perspective view of an electrical connector according to the third embodiment of the present invention. Like the first embodiment, the mount plate 30*b* is restrained by the hook-shaped ribs 212*b* of the metallic housing 20*b*. Difference between the first embodiment and the third embodiment is that rear surface of the insulation frame 10*b* of the electrical connector 200 is assembled with a substrate. The solder areas 211*b* of the metallic housing 20*b* extend along the assembling direction X, and two positioning tongues 312 extend from the mount frame 31*b* of the mount plate 30*b* along the assembling direction X so that the substrate is fixed. The mount portion 32*b* of the mount plate 30*b* extends from the mount frame 31*b* along a direction which is opposite to the direction of which the mount plate 30 extends. According to the third embodiment, there are two mount portions 32*b* which are positioned at two sides of the metallic housing 20*b* and the mount frame 31*b*. The retaining part 311*a* are through holes, and the retaining part 311*b* are grooves.

Referring to FIGS. 6 and 6A-6D, they illustrate the perspective views of the fourth embodiment according to the present invention. Like the third embodiment, the mount plate 30*c* is restrained by the hook-shaped ribs 212*c* of the metallic housing 20*c*, and designs of the insulation frame 10*c*, the metallic housing 20*c* and the mount plate 30*c* have alternatives and depend on different products, but these designs will be assembled by the method described in the present invention.

While the invention has been described with reference to the preferred embodiments, the description is not intended to be construed in a limiting sense. It is therefore contemplated that the appended claims will cover any such modifications or embodiments as may fall within the scope of the invention defined by the following claims and their equivalents.

What is claimed is:

1. An electrical connector, comprising:

a mount plate;

a metallic housing, including a metallic frame and at least one hook-shaped rib extending from the metallic frame for holding the mount plate, wherein the mount plate includes:

a mount frame, at least one retaining part positioned at the mount frame and cooperating with the at least one hook-shaped rib, said hook-shaped rib being bent over an upper surface of said mount frame for retention of said mount frame to said metallic housing, and at least one mount portion, extending from the mount frame, the mount portion in combination with said mount frame forming a substantially L-shaped contour in cross-section and said mount portion having a screw hole for fixing the connector to an object; and an insulation frame, a plurality of terminals being positioned within the insulation frame, the metallic frame covering the insulation frame; the insulation frame having a stop block positioned thereon, and the metallic frame having a guiding groove corresponding to the stop block so that the stop block is guided by the guiding groove to position the metallic housing on the insulation frame.

2. The electrical connector as claimed in claim 1, wherein the electrical connector is a receptacle.

3. The electrical connector as claimed in claim 1, wherein the mount frame is positioned at the metallic frame, and the mount portion is assembled with an object by threading a fixing element through the screw hole and into the object thereby fixing the electrical connector to the object.

4. The electrical connector as claimed in claim 1, wherein the metallic frame has a receptacle hole for receiving a plug.

5. The electrical connector as claimed in claim 1, wherein a plurality of solder areas extend from side surfaces of the metallic frame and are fixed at a substrate.

6. The electrical connector as claimed in claim 1, wherein the retaining part is a through hole or a groove.

7. The electrical connector as claimed in claim 1, wherein the insulation frame includes a tongue extending outwardly, and the tongue has a plurality of terminal grooves which are respectively positioned within the terminals.

8. An electrical connector, comprising:

a mount plate;

a metallic housing, including a metallic frame and at least one hook-shaped rib extending from the metallic frame for holding the mount plate, wherein the mount plate includes:

a mount frame, at least one retaining part positioned at the mount frame and cooperating with the at least one hook-shaped rib, said hook-shaped rib being bent over an upper surface of said mount frame for retention of said mount frame to said metallic housing, and at least one mount portion, extending from the mount frame, the mount portion in combination with said mount frame forming a substantially L-shaped contour in cross-section and said mount portion having a screw hole for fixing the connector to an object; and an insulation frame, and a plurality of terminals being positioned within the insulation frame, and the metallic frame covering the insulation frame, the insulation frame having a retention groove, and the metallic frame having a snap extension corresponding to the retention groove, and when the metallic frame assembles with the insulation frame, the snap extension is restrained by the retention groove so that the metallic housing is positioned on the insulation frame.

9. The electrical connector as claimed in claim 1, wherein the mount plate and the metallic housing are respectively made of different materials.

10. The electrical connector as claimed in claim 9, wherein the mount plate is made of material chosen from a group including iron and plastic.

11. The electrical connector as claimed in claim 9, wherein the metallic housing is made of stainless steel.

* * * * *